US007621156B2

(12) United States Patent
Kim et al.

(10) Patent No.: US 7,621,156 B2
(45) Date of Patent: Nov. 24, 2009

(54) CABINET FOR WASHING MACHINE AND WASHING MACHINE USING THE SAME

(75) Inventors: Jong Seok Kim, Changwon-shi (KR); Yang Hwan No, Changwon-shi (KR); Han Ki Cho, Changwon-shi (KR); Yeon Su Jung, Changwon-shi (KR); Jung Hoon Kang, Changwon-shi (KR); Myung Sik Park, Changwon-shi (KR); Young Hoon Ha, Masan-shi (KR)

(73) Assignee: LG Electronics Inc., Seoul (KR)

( * ) Notice: Subject to any disclaimer, the term of this patent is extended or adjusted under 35 U.S.C. 154(b) by 508 days.

(21) Appl. No.: 10/498,905

(22) PCT Filed: Sep. 9, 2003

(86) PCT No.: PCT/KR03/01860

§ 371 (c)(1),
(2), (4) Date: Jun. 16, 2004

(87) PCT Pub. No.: WO2004/025013

PCT Pub. Date: Mar. 25, 2004

(65) Prior Publication Data

US 2005/0012439 A1 Jan. 20, 2005

(30) Foreign Application Priority Data

Sep. 13, 2002 (KR) ..... 10-2002-0055796
Nov. 28, 2002 (KR) ..... 10-2002-0075049
Nov. 28, 2002 (KR) ..... 10-2002-0075050

(51) Int. Cl.
*D06F 35/00* (2006.01)
*E05D 7/10* (2006.01)

(52) U.S. Cl. ..... 68/23 R; 16/254

(58) Field of Classification Search ..... 68/23 R, 68/23.1; 312/265.6, 228, 228.1, 215, 405, 312/225; 16/71, 221–392; 24/92, 289, 292, 24/293, 297, 324, 442, 453, 594.11, 458; D32/6; 411/508, 509, 913; 248/674
See application file for complete search history.

(56) References Cited

U.S. PATENT DOCUMENTS 704,590 A * 7/1902 Stimson et al. ..... 16/267
1,170,262 A * 2/1916 Meyerowitz ..... 16/268

(Continued)

FOREIGN PATENT DOCUMENTS

JP 58-143688 9/1983

(Continued)

*Primary Examiner*—Michael Cleveland
*Assistant Examiner*—Nicole Blan
(74) *Attorney, Agent, or Firm*—McKenna Long & Aldridge LLP

(57) ABSTRACT

Cabinet for a washing machine is disclosed. The present invention provides a cabinet for washing machine including a base panel 10, one pair of side panels 20 provided to opposite edges of the base panel 10, a front panel 30 provided to front edges of the base 10 and side panels 20, a rear panel 40 provided to rear edges of the base 10 and side panels 20, and a top panel 50 detachably provided to top edges of the side, front, and rear panels 20, 30, and 40.

67 Claims, 12 Drawing Sheets

U.S. PATENT DOCUMENTS 2,655,072 A * 10/1953 Poupitch ..... 411/548
3,695,569 A * 10/1972 Pullan ..... 248/235
4,618,193 A * 10/1986 Cuthbert et al. ..... 312/264
5,307,651 A * 5/1994 Felzer ..... 68/23.5
5,449,228 A * 9/1995 Yoshida et al. ..... 312/215
5,584,549 A * 12/1996 Lybarger et al. ..... 312/265
5,685,623 A 11/1997 Katz et al.
6,042,296 A * 3/2000 Wittig et al. ..... 403/298
6,371,583 B1 * 4/2002 Visin ..... 312/228
6,513,196 B2 * 2/2003 Snowden et al. ..... 16/268

FOREIGN PATENT DOCUMENTS

JP 62-115890 7/1987

* cited by examiner

CABINET FOR WASHING MACHINE AND WASHING MACHINE USING THE SAME

This application claims priority from Korean Patent Application No. 10-2002-0055796 filed Sep. 13, 2002, Korean Patent Application No. 10-2002-0075049 filed Nov. 28, 2002 and Korean patent Application No. 10-2002-0075050 filed Nov. 28, 2002, which are hereby incorporated by reference as if fully set forth herein.

TECHNICAL FIELD

The present invention relates to washing machines, and more particularly, to a cabinet of a washing machine.

BACKGROUND ART

As known, the washing machine is provided with a cabinet and various components held therein. The components include sensitive electronic components and mechanical components for carrying out different motions. For an example, in the cabinet, there are a fast rotating tub, and electronic controller for controlling rotation of the tub. The cabinet protects the electronic components from physical impacts, and the user from moving mechanical components.

The cabinet has a plurality of panels each having a required strength and assembled to one another. In assembly of the panels, in general, flanges of required sizes are form at edges of the panels for fastening to one another with fastening members, such as screws.

However, the formation of the flanges, and the mechanical fastening with the fastening members require much time of work and numerous processes, actually. Therefore, this conventional cabinet results in a poor productivity of a home appliance. Under the same reason, the cabinet also requires much time for disassembly, resulting in inconvenience in maintenance and repair of the home appliance.

DISCLOSURE OF INVENTION

An object of the present invention is to provide a cabinet for a washing machine, which can be assembled and disassembled, easily.

For achieving the object of the present invention, in one aspect of the present invention, there is provided a cabinet for a washing machine including a base panel, one pair of side panels provided to opposite edges of the base panel, a front panel provided to front edges of the base and side panels, a rear panel provided to rear edges of the base and side panels, and a top panel detachably provided to top edges of the side, front, and rear panels.

The top panel is connected to at least one of adjoining other panels when the top panel is disengaged, and preferably to the rear panel, continuously.

The top panel is rotatably mounted on the other adjoining panels, and preferably around a rear end thereof.

In more detail, the cabinet further includes a locking member fitted to the other panels adjoined to the top panel to join with the top panel elastically, and preferably an upper edge of the front panel.

The locking member includes a body configured to be deformed elastically, and caught at the top cover. The body includes a step formed so as to be caught at an edge of the top cover, and a sloped surface for guiding the edge of the top panel to be caught at the body.

The locking member includes legs extended from the body so as to be caught at the other panel, and preferably, further includes a supplementary leg extended from the body for sustaining the body with respect to the other panels.

The cabinet further includes a connection member for rotatably connecting the top panel to one of the other panels, and preferably, fitted between the top panel and the rear panel.

The connection member includes a first bracket fitted to the rear panel, and a second bracket fitted to the top panel and rotatably inserted in the first bracket.

The first bracket includes a seat for receiving the second bracket inserted thereto, and the second bracket includes stoppers for preventing the second bracket from breaking away from the first bracket during the turning of the top panel.

Finally, the cabinet may further include projection members fitted to top edges of the other panels adjoining to the top panel for guiding the top panel, and preferably, fitted to a center of at least the front panel among the panels.

The projection member includes at least more than one legs extended from a lower part to upward so as to be caught at the panel, and a flange extended in a radial direction and supported on the upper surface of the panel.

In another aspect of the present invention, there is provided a washing machine including a washing tub rotatably mounted for washing laundry, a driving device for rotating the washing tub, and a cabinet for holding the washing tub and the driving device, including a base panel, one pair of side panels provided to opposite edges of the base panel, a front panel provided to front edges of the base and side panels, a rear panel provided to rear edges of the base and side panels, and a top panel detachably provided to top edges of the side, front, and rear panels.

Thus, according to the present invention, the top panel can be dismounted/mounted easily, according to which the service on the washing machine is carried out conveniently.

BRIEF DESCRIPTION OF DRAWINGS

The accompanying drawings, which are included to provide a further understanding of the invention, illustrate embodiment(s) of the invention and together with the description serve to explain the principle of the invention. In the drawings;

FIGS. 5A and 5B illustrate partial section and plan view each showing a projection member guiding a top cover of a washing machine cabinet.

BEST MODE FOR CARRYING OUT THE INVENTION

Figure 1:
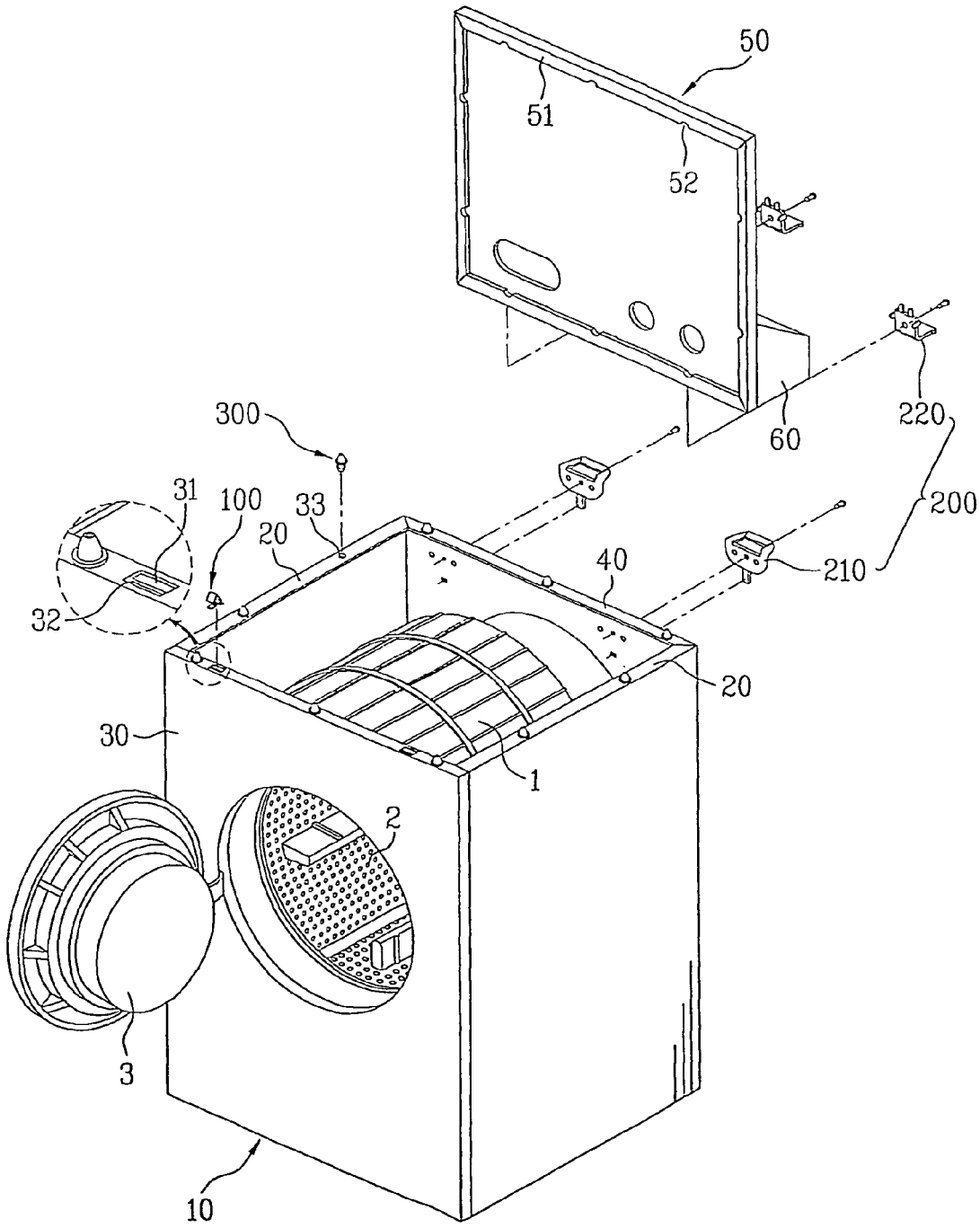
FIG. 1 illustrates a perspective view of a cabinet for a washing machine in accordance with a preferred embodiment of the present invention.

Reference will now be made in detail to the preferred embodiments of the present invention, examples of which are illustrated in the accompanying drawings. In describing the embodiments, same parts will be given the same names and reference symbols, and repetitive description of which will be omitted. FIG. 1 illustrates a perspective view of a cabinet for a washing machine in accordance with a preferred embodiment of the present invention.

Referring to FIG. 1, the washing machine cabinet in accordance with a preferred embodiment of the present invention includes base, side, front, rear, and top panels 10, 20, 30, 40, and 50 joined to one another on the whole. One pair of side panels 20 are fastened to opposite edges of the base plate 10. The front panel 30 and the rear panel 40 are fastened to front and rear edges of the base panel 10 and the side panels 20. The top panel 50 is fastened to top edges of the side, front and rear panels 20, 30, and 40. The cabinet may have a control panel 60 mounted thereon for operation of the washing machine. In FIG. 1, though the control panel 60 is mounted on the top panel 50, a position of mounting the control panel may be changed if required. Thus, basically, the cabinet forms a space for holding main components of the home appliance therein, and protects the components.

Inside of the cabinet, there are a washing tub configured to wash laundry and driving means for rotating the washing tub. In general, the washing tub includes an outer tub 1 for preliminary storage of washing water, and an inner tub 2 rotatably mounted in the washing tub. Though not shown, the driving means includes a motor, a driving shaft connected between the motor and the washing tub for driving the washing tub, a clutch, and the like. The laundry is introduced into the washing nib through a door 3, and washed and extracted of water as the washing tub, more specifically, the inner tub 2 rotates. In the meantime, the door 3 may be mounted on the front panel 30 or the top panel 50 depending on arrangement of inside components, particularly the washing tub. That is, as shown, if the washing tub is mounted in a laid down position, the door 3 is mounted on the front panel 30 (so called, a front loading type washing machine). On the other hand, if the washing tub is mounted in an upright position, the door 3 is mounted on the top panel 50. (so called, top loading type washing machine).

For services, such as exchange and repair of the inside components, it is required to disassemble the cabinet. Particularly, when the top panel 50 is removed, access to the inside components is easiest. That is, the service can be easy, only if the top panel 50 can be removed, easily. Therefore, the present invention suggests, not full fixing, but detachable fastening, of the top panel 50 to the other panels 20, 30, and 40.

For providing such a top panel 50, locking members 100 are provided to the cabinet of the present invention for engagement with the top panel 50. The locking member 100 is elastically deformable, to engage with/disengage from the top panel 50 while the locking member 100 is deformed/restored by an external force. The locking members 100 are fitted to other panels adjoining the top panel 50, i.e., side, front, and rear panels 20, 30, and 40, more specifically, fitted to top edges of the panels 20, 30, and 40 direct opposite to the top panel 50. Moreover, for more stable and easy fitting, the locking members 100 may be inserted in holes 31 formed in the top edges of the panels 20, 30, and 40. It is preferable that the locking member is fitted at least more than one, for firm engagement with the top panel 50.

Figure 2A:
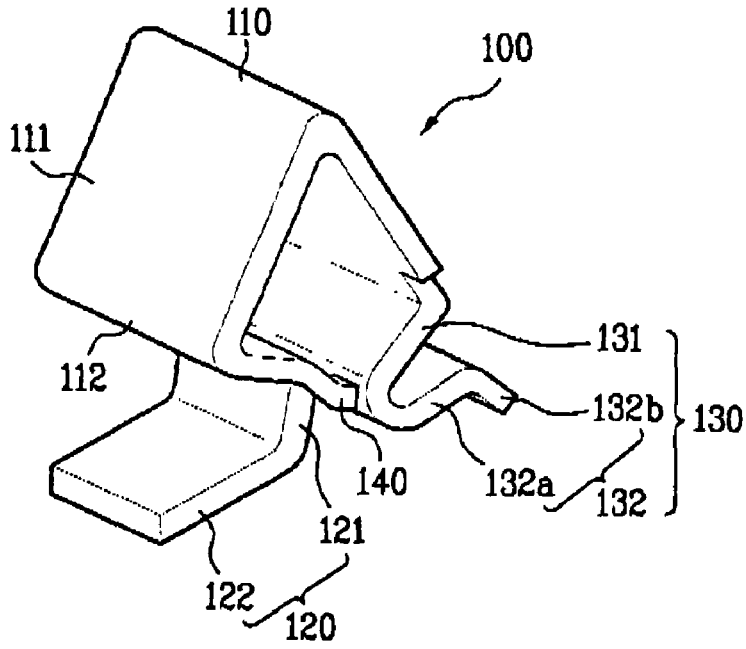
FIGS. 2A and 2B illustrate perspective, and front views each showing a locking member for a cabinet in accordance with a preferred embodiment of the present invention.
Figure 2B:
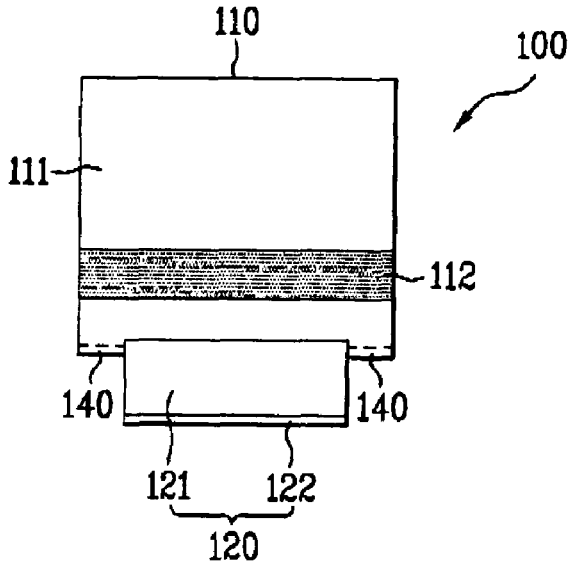
Figure 3:
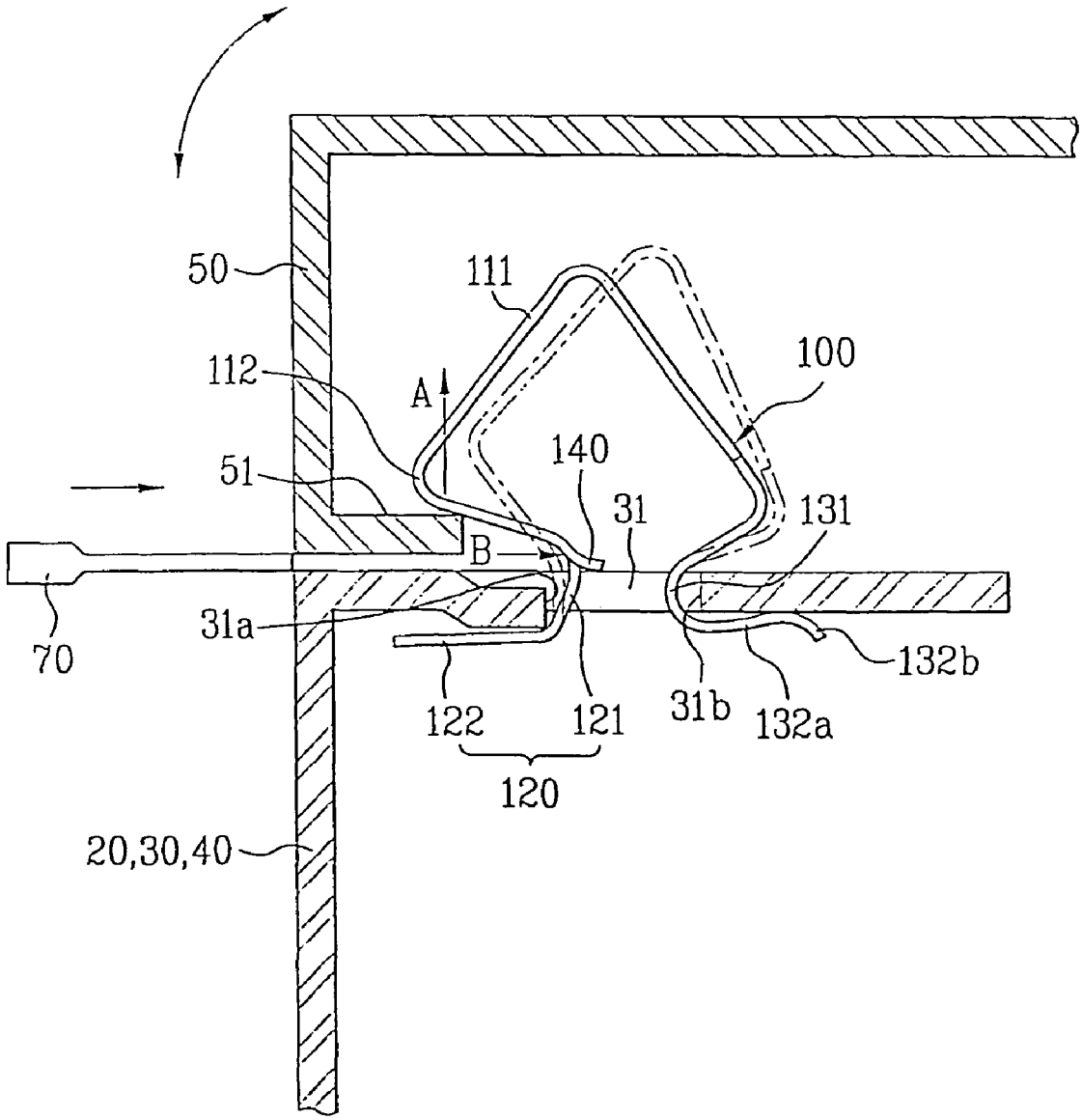
FIG. 3 illustrates a partial section showing a locking member joined with a top cover of a washing machine cabinet.

FIGS. 2 and 3 illustrate the locking members in detail.

Figure 4:
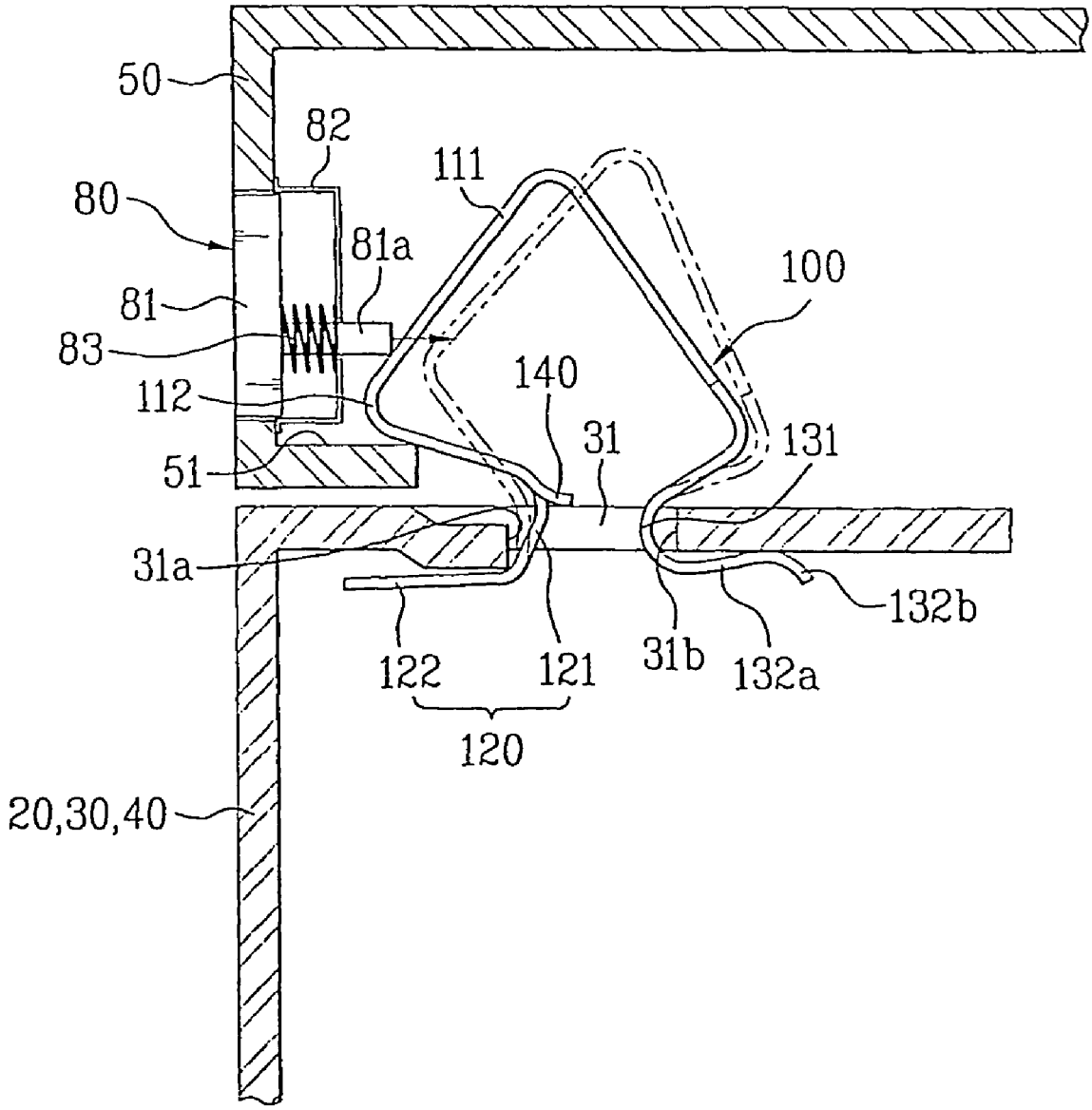
FIG. 4 illustrates a partial section showing a locking member having pressing means applied thereto.

Referring to FIGS. 2A and 2B, as described before, basically the locking member 100 includes a body 110 configured to deform elastically and be caught by the top cover 50. In more detail, as shown in FIG. 3 well, the body 110 has steps 112 for catching the edge of the top panel 50. For catching the top panel 50, it is required that the step 112 is formed at a position where the step 112 can be in contact with the top panel 50, according to which the step is formed in a front portion of the body 110. For stable catch of the step 112, the top panel 50 also has a length of flange 51 at the edge of the top panel 50. The top panel 50 actually engages with the locking member 100 with the step 112, and is fastened to other panels 20, 30, and 40 with the locking members 100. Adjoined to the step 112, there is a sloped surface 111 in the body 110. Preferably, the sloped surface 111 is formed continuous from the step 112 to guide the edge of the top panel 50 to the step 112. Therefore, as shown in FIG. 3, the edge 51 of the top panel 50 is deformed as the edge 51 is brought into contact with the body 110, and thereafter caught at the step 112. Alternatively, when an appropriate external force is applied to the body 110, the body is deformed, to release the top panel 50. That is, basically, the body 110 is deformed so as to be disengaged from the top panel 50 by the external force generated at the time the top panel 50 is lifted. Moreover, for easier disengagement of the top panel 50, appropriate pressing means may be used for pressing the body 110. At first, the pressing tool 70 is inserted in the cabinet for pressing the body 110, according to which the body 110 is deformed to a greater extent, to release the top panel 50. Moreover, as shown in FIG. 4, a pressing member 80 mounted to the top panel 50 may be used as the pressing means. The pressing member 80 includes a button 81 in the top panel 50, a bracket 82 for supporting the button 81, and an elastic member 83 between the bracket 82 and the button 81. The button 81 has a projection 81*a* extended toward the body 110 positioned adjacent to the body 110 through the bracket 83. The elastic member 83 elastically supports the button 81 together with the bracket 83. Therefore, if the button 81 is pressed, the projection deforms the body 110 so as to release the top panel 50. As described before, with the body 110, the top panel 110 is fastened to other panels 20, 30, and 40, easily. Moreover, the top panel 110 is held at the panels 20, 30, and 40 stably during regular use of the washing machine, and can be separated from the other panels 20, 30, and 40, if an appropriate force is applied thereto. The body 110 is formed of an elastic substance, and preferably formed by bending plate for reduction of cost and weight.

The body 110 has legs 120 and 130 for fitting the body 110 to the panel 20, 30, or 40. The legs 120 and 130 are extended from the body 110 and engaged with the top panel 50. That is, referring to FIG. 3, the legs 120 and 130 are inserted in a hole 31, and engaged with an edge of the hole 31. For stable fastening of the body 110 to the panel 20, 30), or 40, the body 110 has a first leg 120 in a front part, and a second leg 130 in rear part.

The first leg 120 has a first part 121 extended from the body 110 downwardly, and a second part extended from the first part 121 forwardly. Though the first part 121 may be extended vertically, it is preferable that the first part 121 is sloped forwardly. As described before briefly the pressing tool 70 may be used for deforming the body 110 (see FIG. 3). Conveniently, the pressing tool 70 may be inserted through a gap between the top panel 50 and the other panel 20, 30, or 40. In this case, the pressing tool 70 applies a pressure to the first part 121 of the first leg 120 for deforming the body 110 connected thereto. If the first part 121 is sloped forwardly, even if the pressing tool 70 is slipped on a surface of the first part 121, the pressing tool 70 is guided along the sloped surface, to be able to press a boundary of the body 110 and the first leg 120 continuously. As shown, the second part 122 is extended horizontally, opposite to an inside surface of the panel 20, 30, or 40, wholly. Therefore, the second part 122 hold the locking member 100 rigidly so as not to separate from the hole 31. As shown in FIGS. 1 and 3, preferably, the there may be an indented portion 32 in the vicinity of the second part 122 of the panel 20, 30, or 40. That is, a cavity is formed in a front part of the hole 31. The indented part 32 permits the second part 122 to be in direct contact with an inside surface of the panel directly, to hold the hole 31 more rigidly.

Basically, the second leg 130 includes a first part 131 extended downwardly from the body 110, and a second part 132 extended backwardly from the first part 131. As described before, when it is intended to mount/dismount the top cover 50, a force is applied to a front part of the body 110, to push the body 110 backward. In this case, as shown in FIG. 3, it is preferable that the first part 131 is sloped forwardly for guiding a rear end 31*b* of the hole toward the second part 132. According to this, if the body 110 is pushed backward, instead of breaking away from the second leg 131, the rear end 31*b* of the hole rigidly is held between the first and the second parts 131 and 132. The second part 132 is formed to be in direct contact with an inside surface of the panel 20, 30, or 40, in overall. For this, the second part 132 has a first sloped part 132*a* slope upwardly. That is, the first sloped part 132*a* is extended upwardly from the first part 131, and brought into contact with the inside surface of the panel 20, 30, or 40, to hold the body 110 so as not to break away from the hole 31. The second sloped part 132*b* is extended downwardly from the first sloped part 132*a*, continuously. The second sloped part 132*b* guides the rear end 31*b* of the hole to slide upward relative to a surface of the second sloped part 132*b* when the second leg 130 is inserted. Accordingly, the second leg 130 can be inserted in the hole 31 with a small force.

The locking member 100 may include a supplementary leg 140 extended from the body 110. As shown in FIG. 3, the supplementary leg 140 is brought into contact with an upper surface of the panel 20, 30, or 40, to sustain the body 110 to be at a height over the panel 20, 30, or 40. The supplementary leg 140 is formed to adjoin to the front part of the body 110 the external force is applied thereto, and, as shown in FIG. 2B, at opposite sides of the body 10, for stable supporting of the body 110.

By using such different legs 120, 130, and 140, the locking member 100 can be fitted to, or removed from the panel 20, 30, or 40, easily. Moreover, the legs 120, 130, and 140 permit the locking member 100 to hold the panels 20, 30, or 40 rigidly, thereby preventing occurrence of vibration or noise during operation of the washing machine.

As described before, the top panel 50 can be mounted/dismounted with the locking members 100. However, actually a service man dismounts the top panel 50 from the cabinet, puts in the vicinity of the washing machine, and mounts to the cabinet again when the repair is finished. As such, the complete dismounting/mounting of the top panel 50 from/to other panels every time the washing machine is repaired may be not convenient for the service man. Therefore, in the present invention, it is configured such that, even if the top panel 50 is dismounted, the top panel 50 is connected to any one of the other panels 20, 30, or 40. Moreover, more conveniently, the top panel 50 is rotatably mounted to any one of the panels 20, 30, and 40. For this, as shown in FIG. 1, the cabinet of the present invention includes a connection member 200 for movably connecting the top panel 50 to one of the panels 20, 30 and 40. In general, since the service man repair the washing machine standing in front of the front panel 30, preferably, the connection member 200 is fitted between the top panel 50 and the rear panel 40. For convenience of the service man owing to the connection member 200, the top panel 40 is turned around a rear end thereof, connected to the rear panel 40 continuously. A likely, for the service man to apply a force to the locking member 100, and separate the top panel 50 easily, preferably, the lock member 100 is fitted to the front panel 30 opposite to the connection member 200. The locking and connection members 100 and 200 fitted to the front and rear parts, provide an adequate fastening force to the top panel 50, enough to require no more locking member 100 for the side panels 20 or the rear panel 40, additionally.

Figure 5:
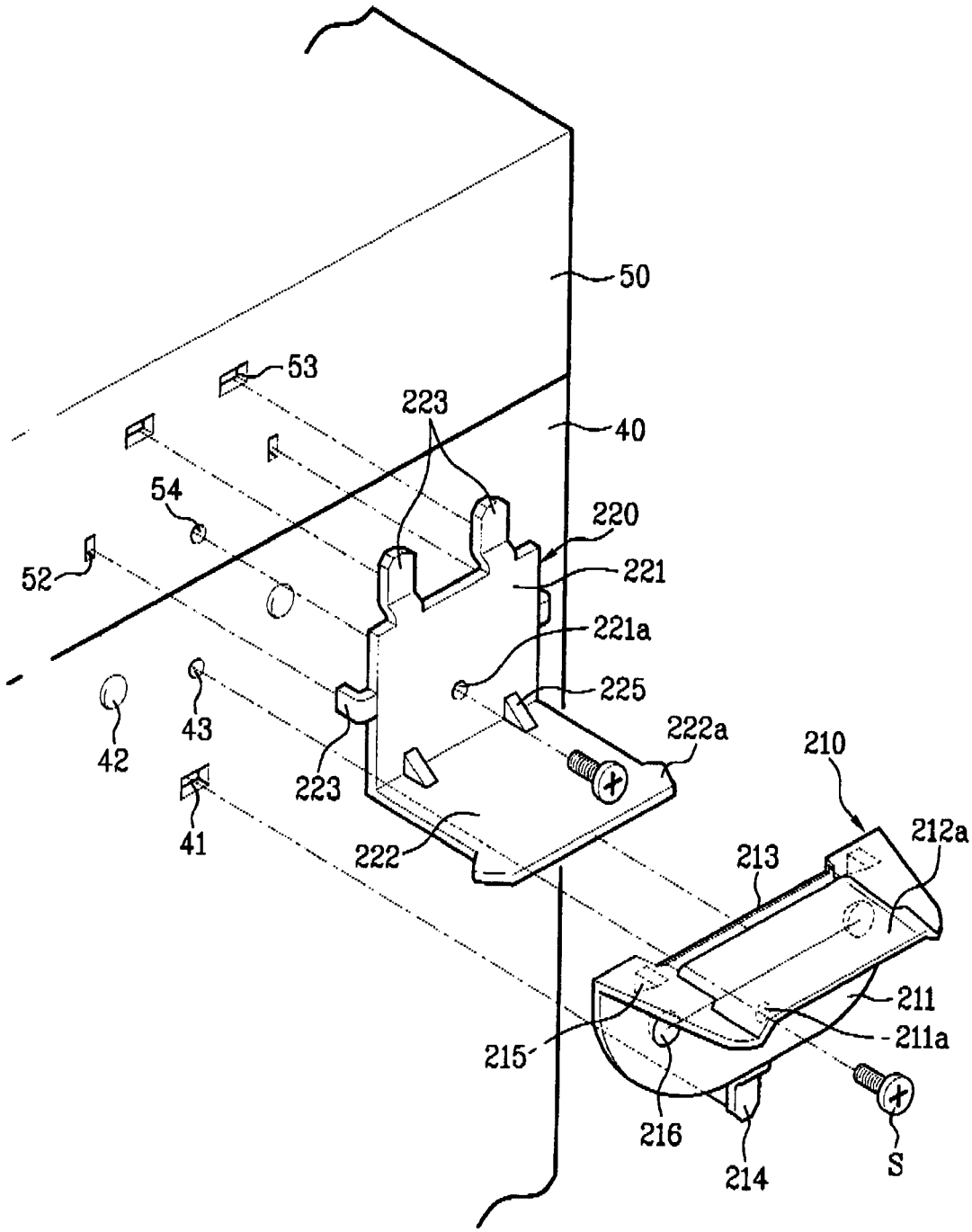
FIG. 5 illustrates a perspective view showing a connection member for a cabinet in accordance with a preferred embodiment of the present invention.

As shown in FIG. 5 in detail, the connection member 200 includes a first bracket 210 fitted to the rear panel 40, and a second bracket 220 fitted to the to panel 50, and rotatably inserted in the first bracket 210. As shown, since the second bracket 220 is not fastened to the first bracket 210 with fastening members, the second bracket 220 is separable from the first bracket 210. Therefore, if required, the top panel 50 can be separated from the cabinet fully for the convenience of the service man. In the connection member 200, the first bracket 210 includes a first part 211 fixed to the rear panel 40, and a second part 212 extended from the first part 211 away from the rear panel 50. There is a through hole 213 at an intersection of the first part 211 and the second part 212. For adjusting a turning angle of the top panel 50, though the second part 212 may have various angles with respect to the first part 211, it is appropriate that the second part 212 is extended horizontally from an upper part of the first part 211. The second bracket 220 includes a first part 221 fixed to the top panel 50, and a second part 222 extended from the first part 221 away from the top panel 50. Though the second part 222 may also be sloped at various angles similar to the second part 212 of the first bracket, the second part 222 is extended from a lower part of the first part 221, appropriately. The second part 222 is inserted in the through hole 213, so as to be rotatable between the first part 211 and second part 212 of the first bracket 210.

Figure 6A:
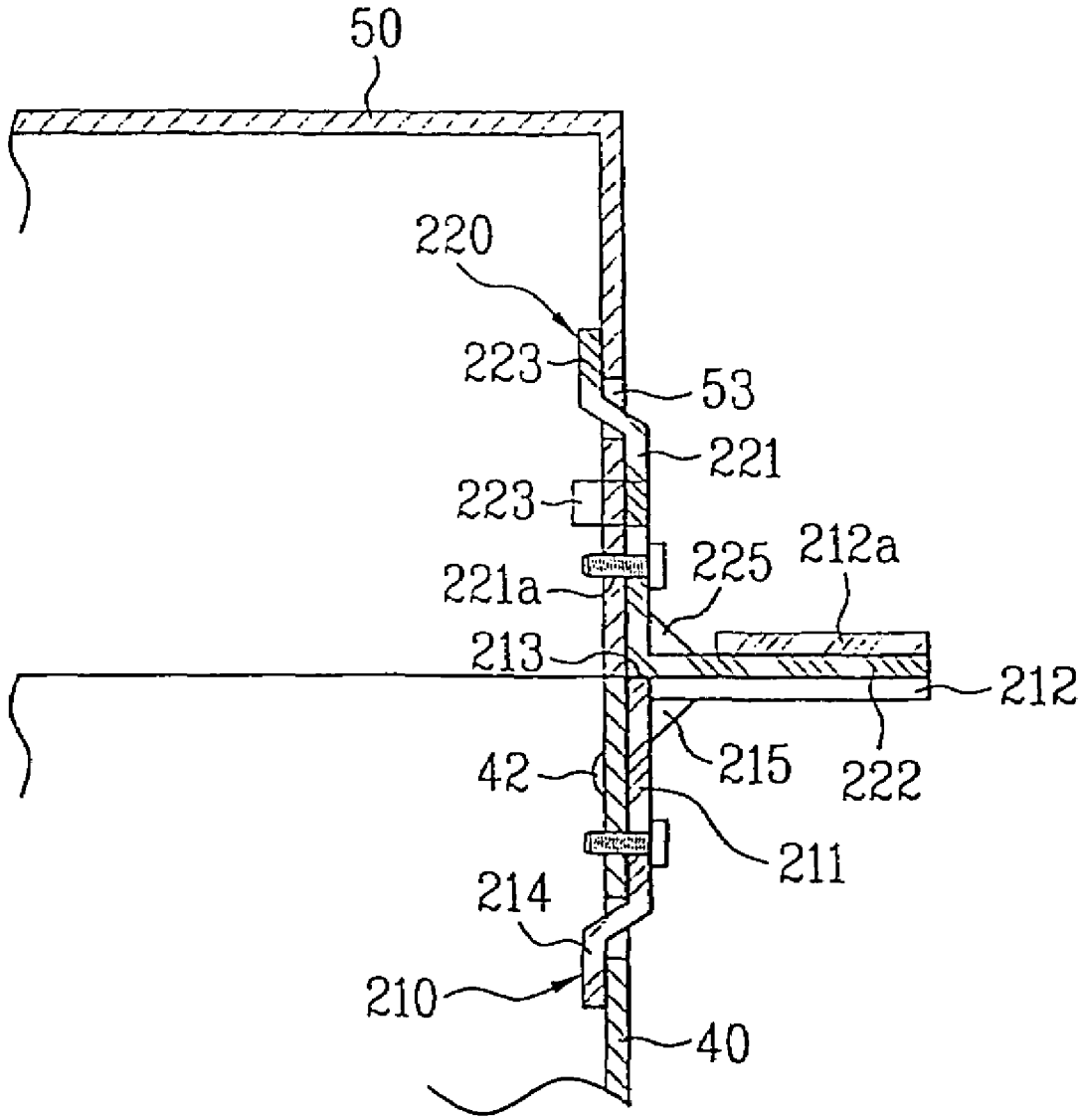
FIGS. 6A and 6B illustrate side sectional views each showing operation of the connection member.
Figure 6B:
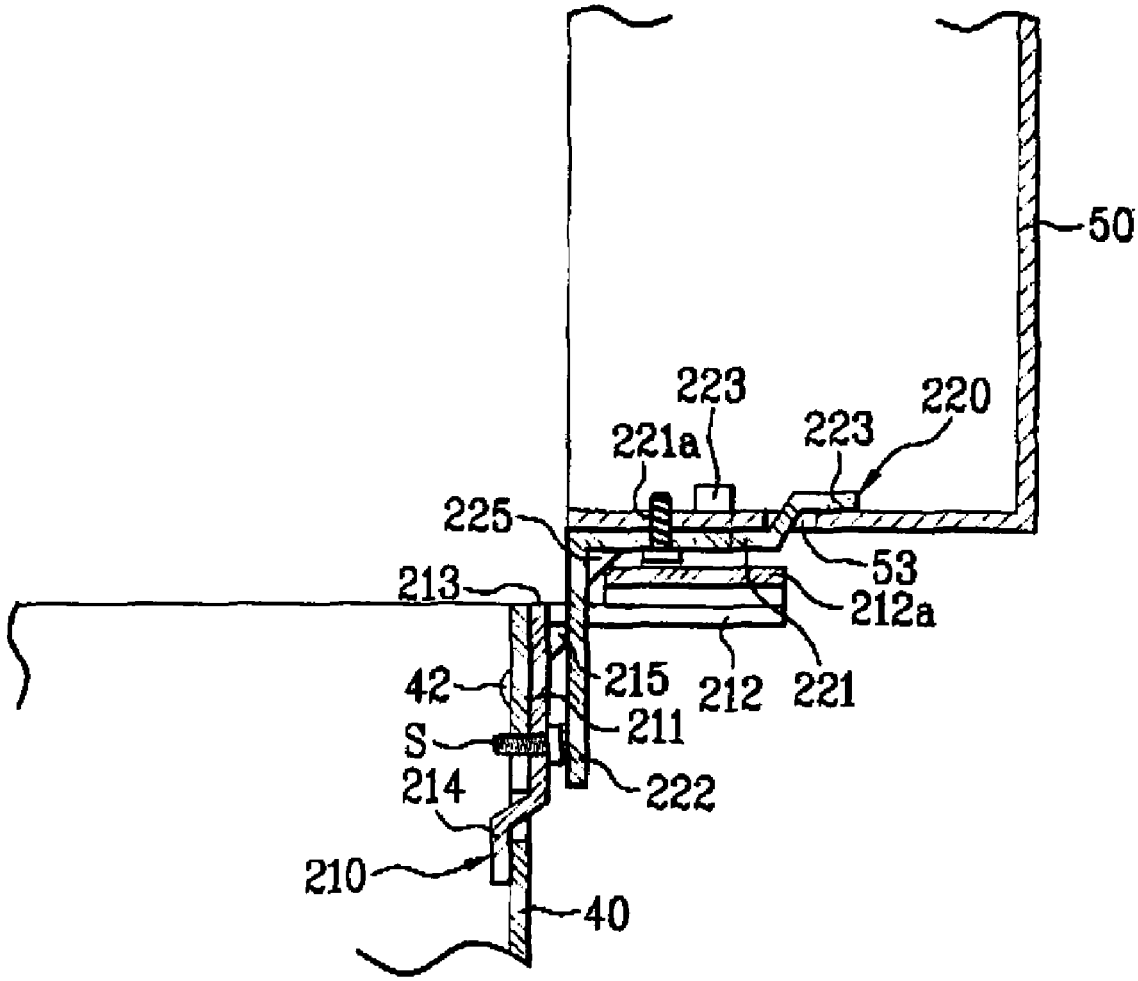
Figure 7:
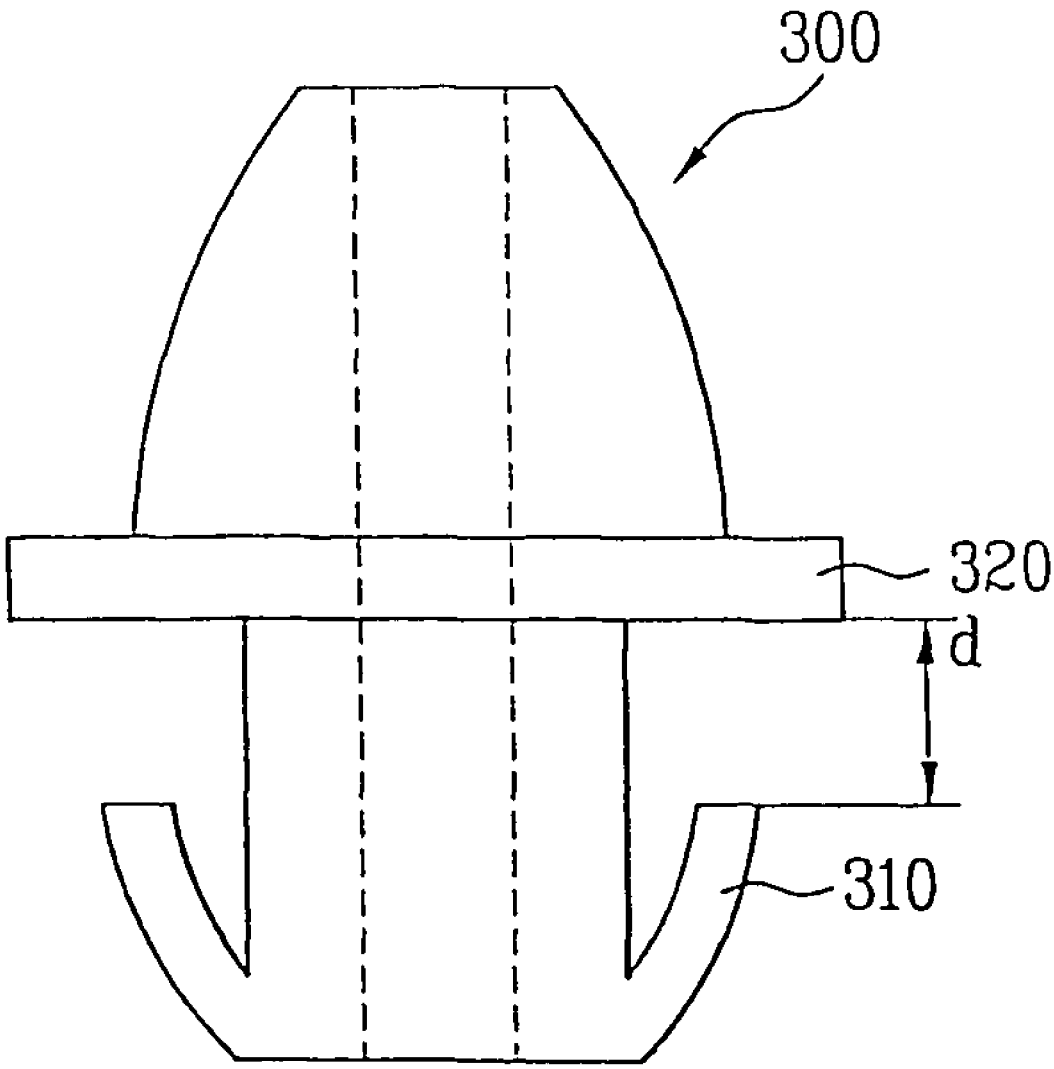
FIG. 7 illustrates a front view of a projection member for a cabinet in accordance with a preferred embodiment of the present invention.

In more detail, the first bracket 210 has a seat 212*a* for receiving the second bracket 220 inserted therein. The seat 212*a* is formed by bending the second part 212 of the first bracket for receiving the second part 222 of the second bracket, substantially. Therefore, when the top panel 50 is on the other panels 20, 30, and 40, the seat 212*a* prevents the second bracket 220, as well as the top panel 50 collected thereto, from breaking away from the first bracket 210. The first bracket 210 has a first projection 214 extended therefrom for inserting in the rear panel 40, and second projections 216 extended from the first bracket (i.e., the first part 211) so as to be inserted in the rear panel 40. There are holes 41 and 42 in the rear panel 40 in correspondence to the projections 214 and 216. The rear panel 40 has a fastening hole 43, and the first bracket 210 also has a fastening hole 211*a* in correspondence to the fastening hole 43. Since the first bracket 210 is joined with the rear panel 40 with the projections 214 and 216 preliminarily, the first bracket 210 can adequately be fastened to the rear panel 40 perfectly, only with one fastening hole 43 and 211*a* and a fastening member 'S'. In the meantime, when the top panel 50 turns to open the cabinet, a part of the inserted second bracket 220 is brought into contact with the first bracket 210. That is, as shown in FIG. 6B, the second part 222 of the second bracket is brought to a position adjacent to the first part 211, particularly, brought into a direct contact with the fastening member 'S'. Therefore, the fastening member 'S' is configured to support the second bracket 220, more specifically, the second part 222. In this instance, it is preferable that the fastening member 'S' is a screw having a flat top head for uniform contact with the second part 222.

The second bracket 220 has stoppers 222*a* for preventing the second bracket 220 from breaking away from the first bracket 210. The stoppers 222*a* are formed on the second part 222 of the second bracket, for being caught at edges of the through hole 213 in the first bracket. Therefore, when the top panel 50 turns, the second bracket 220 does not break away from the first bracket 210, and the top panel 50 turns stably. Moreover, similar to the first bracket 210, the second bracket 220 also has third projections 223 extended from the second bracket 220 so as to be inserted in the top panel 50. For insertion of the projections 923, the top panel 50 has holes 53. Moreover, the top panel 50 has fastening holes 54, and the second bracket 220 also has fastening holes 221*a* in correspondence to the fastening holes 54. As described before, owing to the projections 223, the second bracket 220 can be fastened to the top panel 50 only with one fastening hole 54 and the fastening member. When the top panel 50 starts to turn, entire weight of the top panel 50 is put on the first and second brackets 210 and 220. Therefore, for reinforcing the bent parts of the first and second brackets 210 and 220, ribs 215 and 225 are formed. That is, the ribs 215 and 225 are formed at connection parts of the first parts 211 and 221 and the second parts 212 and 222 of the first and second brackets.

In the meantime, since the top panel 50 is a member having substantial weight and size, accurate positioning of the top panel 50 on the other panels 20, 30, and 40 are not easy. Moreover, if the top panel 50 is dismounted/mounted repeatedly for repair or change of components, it is liable that the top panel 50 is not aligned to the other panels 20, 30, and 40. Therefore, as shown in FIG. 1, projection members 300 may be fitted to upper edges of the other panels 20, 30, and 40 for guiding the top panel 50, additionally. As described, the top panel 50 is mounted on the other panels 20, 30, and 40 with the locking members 100 fitted to the front panel 30, lastly. Therefore, for accurate positioning of the top panel 50, it is required that the projection member 300 is fitted at least to a center part of the front panel 30. For cooperation with the projection member 300, the top panel 50 has recesses 52 formed in conformity with the projection members 300, respectively. As shown in FIGS. 5A and 5B, actually, the recesses 52 are formed to receive respective projection members 300 partially when the top panel 50 is positioned, accurately. Thus, the top panel 50 can be positioned accurately by engagement between the recesses 52 and the projection members 300.

Figure 8A:
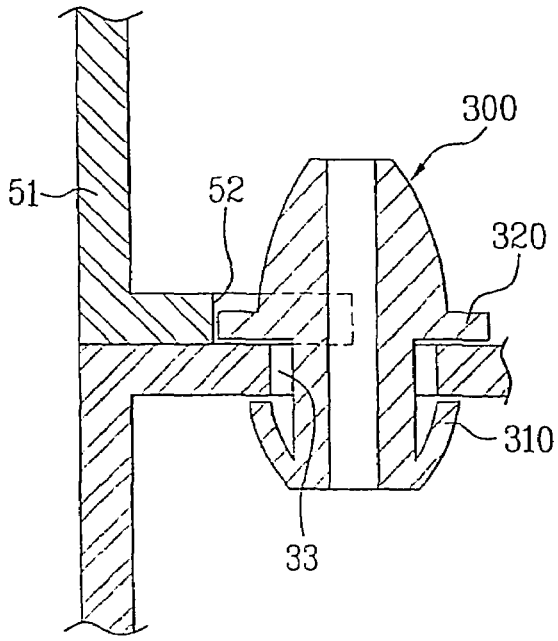
Figure 8B:
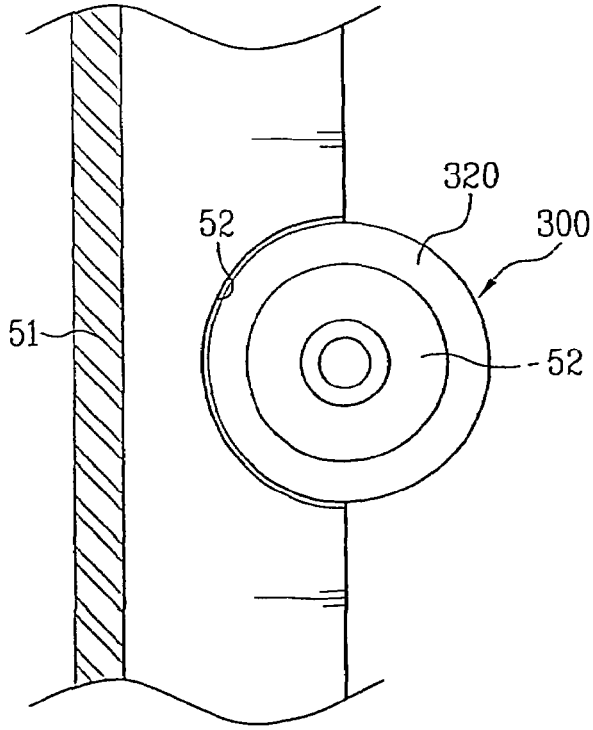

Moreover, for simple fitting, preferably the projection member 300 is configured to fasten to the upper edge of the panel 20, 30, or 40 directly without any fastening member. For this, the projection member 300 has at least more than one leg 310 extended upward from a lower part. As shown in FIGS. 1 and 8, the leg 310 is inserted in the hole 33 in the panel 20, 30, or 40 and caught at an inside surface of the panel 20, 30, or 40 rigidly so that the projection member 300 does not break away. Together with the leg 310, the projection member 300 has a flange 320 extended in a radial direction of the projection member 300. The flange is supported on an upper surface of the panel 20, 30, or 40, such that the projection member 300 can be projected to a fixed height from the panel 20, 30, or 40. Therefore, for fitting the projection member 300 to the panel 20, 30, or 40, it is required that a gap 'd' between and end of the leg 310 and the flange 320 is at least thicker than a thickness of the panel 20, 30, or 40. Moreover, for rigid fastening of the projection member 300 to the panel 20, 30, or 40, without movement, it is preferable that the gap 'd' is the same with the thickness of the panel 20, 30, or 40.

Thus, in the cabinet of the present invention, the top panel 50 can be mounted /dismounted to/from the cabinet easily by using different members 100, 200 and 300, and fitting processes of the different members 100, 200, and 300, and the operation of the cabinet of the present invention will be described in detail.

In general, for consistent and convenient assembly of the washing machine, the base, sides, and rear panels 10, 20, 40 are fastened to one another to form a basic frame for forming a space for holding various components. Various components are mounted in the space inside of the fastened panels 10, 20, and 40. For an example, the inner/outer tubs 1 and 2, and driving means for rotating the inner/outer tubs are mounted in the space. Then, the front panel 30 is fastened to the side and base panels 20 and 10 fastened to one another.

Before mounting the top panel 50 on the other panels 20, 30, and 40, the different members 100, 200, and 300 are fitted to the cabinet. At first, the locking member 100 is fitted to the upper edge of the front panel 30. More specifically, as shown in FIGS. 1 and 3, at first, the first leg 120 is inserted in the hole 31, such that the first leg 120 is caught at a front end 31*a* of the hole. Then, white pressing down the body 110 slightly, the second leg 130 is inserted in the hole 31 such that the second leg 130 is caught at a rear end 31*b* of the hole 31. During the insertion, the second sloped part 132*b* slides on the rear end 31*b* to guide the second leg 130 to be inserted in the hole 31 easily. A likely, the second leg 130 can be removed from the hole 31 easily by the second sloped part 132*b*. Moreover, since the first leg 120 is inserted at first, the first leg 120 is formed longer than the second leg 130 so that the first leg 120 is held n the hole 31 stably during insertion of the second leg 120. Since the second leg 130, having a relatively short length, can be inserted in the hole easily even with a slight deformation of the body 110, it is advantageous. With the legs 120 and 130, the locking member 100 can be rigidly and conveniently fitted to, and removed from the front panel 30 without using any fastening member.

Referring to FIGS. 1 and 5, in the connection member 200, the first bracket 210 is fitted to the rear panel 40 and the second bracket 220 is fitted to the rear end of the top panel 50. In more detail, at first, the first and second projections 214 and 216 of the first bracket 210 are inserted in the holes 41 and 42 in the rear panel respectively, and the third projection of the second bracket 220 is inserted in the hole 53. As has been described, the first and second brackets 210 and 220 are connected to each other and make relative motion to each other, fastening to accurate positions is required for accurate motion. Accordingly, the first and second brackets 110 and 120 are respectively positioned at accurate positions on the rear panel and the top panel 40 and 50 stably with the projections 214, 216, and 223, and holes 41, 42, and 53. Thereafter, the first and second brackets 110 and 120 are fastened to the rear panel and top panel 40 and 50 with the fastening holes 211*a*, 43, 221*a*, and 54, and the fastening member 'S'. In fastening the brackets, since the projections 214, 216, and 223 already provide substantial fastening forces, numbers of the fastening members and fastening holes can be reduced.

Finally, the projection members 300 are fitted to tops of the panels 20, 30 and 40. As shown in FIGS. 1 and 8, once a lower part of the projection member 300 is inserted in the hole 33, the legs 310 are inserted between the hole 33 and the body of the projection member, and folded toward the body of the projection member 300. In this instance, if the body of the projection member is deformed slightly, the body and the leg 310 can be inserted in the hole 33 easily. Therefore, it is preferable that the projection member 300 has a hollow body that is favorable for the deformation. Thereafter, if the projection member 300 is inserted further into the hole 33 until the flange 320 is brought into contact with the edge of the hole 33, the legs 310 are released from the hole 33, unfolded, and caught at the edge of the hole 33. According to this, the projection member 300 can be rigidly fastened to the panel 20, 30, or 40 easily, thereby shortening assembly, and fabrication time periods of the washing machine.

When assembly of the different members 100, 200, and 300 are finished, the top panel 50 is mounted on the other panels 20, 30, and 40 by using the members 100, 200 and 300. At first, as shown in FIG. 5, the second part 222 of the second bracket is inserted in the through hole 213 in the first bracket. As shown, in view of a position of the through hole 213 (i.e., a corner of the first bracket 210), if the top panel 50 is lifted slightly with a slope over the other panels 20, 30, and 40, the second part 222 can be inserted in the through hole 213 more easily. According to this insertion, basically the top panel 50 is rotatably inserted in the rear panel 40. Then, as shown in FIG. 3, if the top panel 50 is put down to the other panels 20, 30, and 40, a fore end of the top panel 50, more precisely, the flange 51 is brought into contact with the sloped surface 111. Then, as the flange 51 is guided along the sloped surface 111, the body 110 is deformed as indicated with dashed line due to weight of the panel 50. When the flange 51 comes down to a position, the body 110 is restored, such that the flange 51 is caught at the step 111. During the fastening of the top panel 50 and the locking member 100, once the projection member 300 meets with the recess 52, the projection member 300 is received at the recess 52 so as not to break away from the recess 52. Thereafter, as the recess 52 is kept guided by the projection member 300, the top panel 50, i.e., the flange 51 is engaged with the locking member 100 at an accurate position thereof. That is, the projection member 300 serves to fix a mounting position of the top panel 50.

Figure 9A:
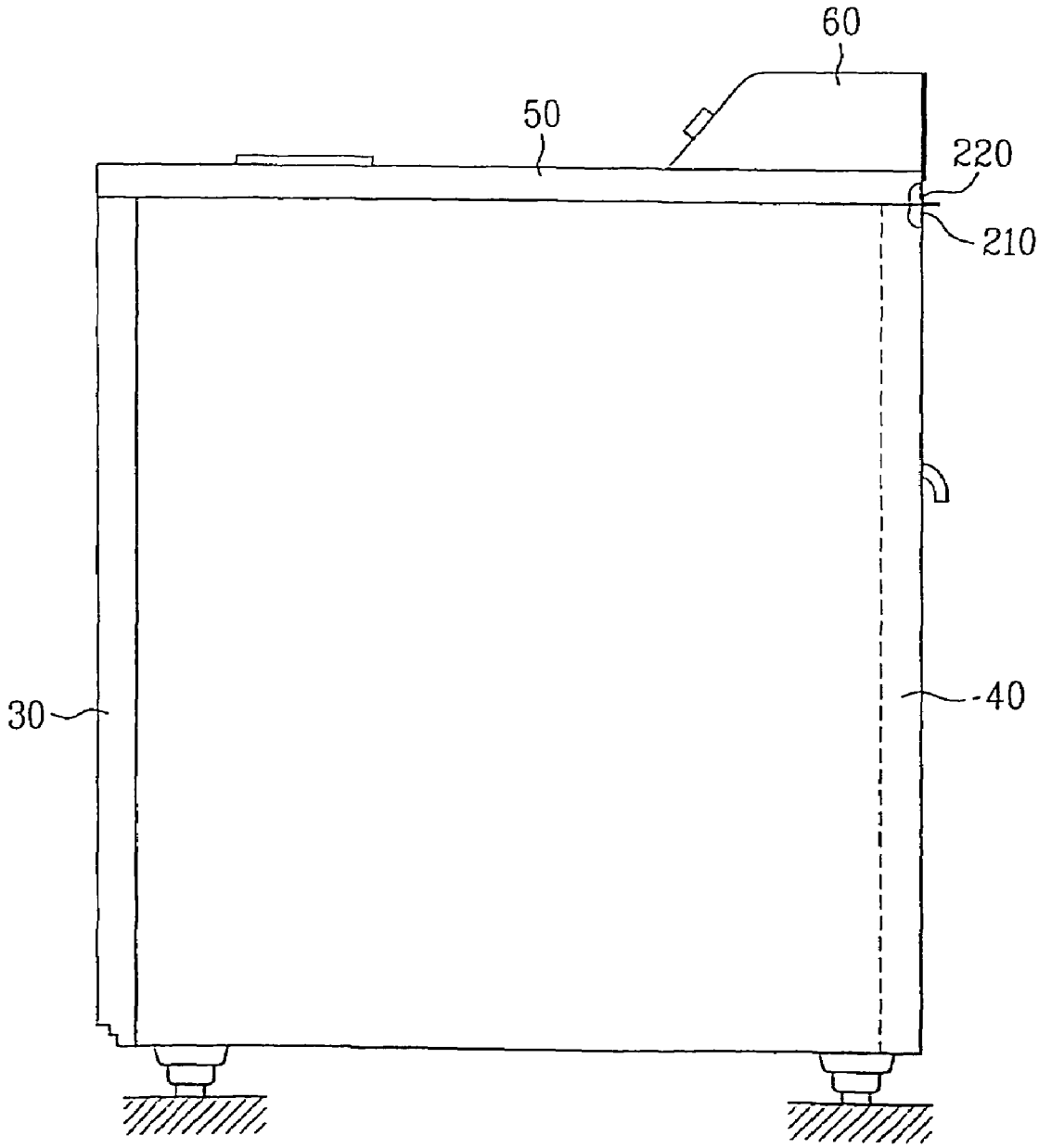
FIGS. 9A~9C illustrate side views each showing operation of a washing machine cabinet in accordance with a preferred embodiment of the present invention.

As shown in FIG. 9A, by means of the different members 100, 200, and 300, basically, the top panel 50 is mounted to cover a top part of the cabinet without using fastening member. Therefore, the top panel 50 can be mounted on the cabinet easily, thereby reducing substantial working time period and process of washing machine production. Moreover, as shown in FIG. 6A, once the top panel 50 is mounted, as the second part 222 of the second bracket is brought into contact with the second part 212 of the first bracket, the second part 222 is rigidly supported on the second part 212. Accordingly, the top panel 50 is not separated, or moved during use of the washing machine. Moreover, since the locking member 100 and the projection member 300 are fastened to the top panel 50 rigidly and supports the top panel 50, occurrence of noise and vibration is prevented during operation of the washing machine.

The washing machine, assembled thus, requires service during use for smoother operation. For an example, the components are required to be repaired or changed, and inspection of overall function is required. In this case, the user or the service man in general dismount the top cover 50 of the washing machine. In the present invention, for dismounting the top cover 50, the locking member 100 is disengaged from the top panel 50 at first. At first, as shown in FIG. 3, when the service man or the user lifts the top panel, a force is applied to the body 110 of the locking member in an 'A' direction by an edge of the top panel 50, i.e., the flange 51. Then, the flange 51 slides on a lower surface of the step 112, to deform the body 110 as shown in a dashed line, and is released from the body (i.e., the step) 110, accordingly. Therefore, only the lifting of the top panel 50 can separate the top panel 50 from the cabinet. This implies that the top panel 50 is detachably mounted on the cabinet (i.e., the other panels 20, 30, and 40), actually. Moreover, as shown in FIG. 3, in a case the pressing means 70 or 80 is used for dismounting the top cover 50, the pressing tool 70 is inserted between the top panel 50 and the front panel 30, and presses the first leg 120 in a 'B' direction. According to this, the body 110 connected to the first leg 120 is deformed as shown in a dashed line, and by lifting the top panel 50, the top panel 50 is disengaged from the step 112. As shown in FIG. 4, when the user presses the button 81 on the pressing member, the projection 81*a* connected to the button 81 directly presses the body 110, to deform the body 110 as shown in the dashed line. Therefore, if the top panel 50 is lifted in a state the button 81 is pressed, the flange 51 of the top panel 50 is disengaged from the step 112. Thereafter, when a force applied to the button 81 is removed, the button 81 is restored by the elastic member 83.

Figure 9B:
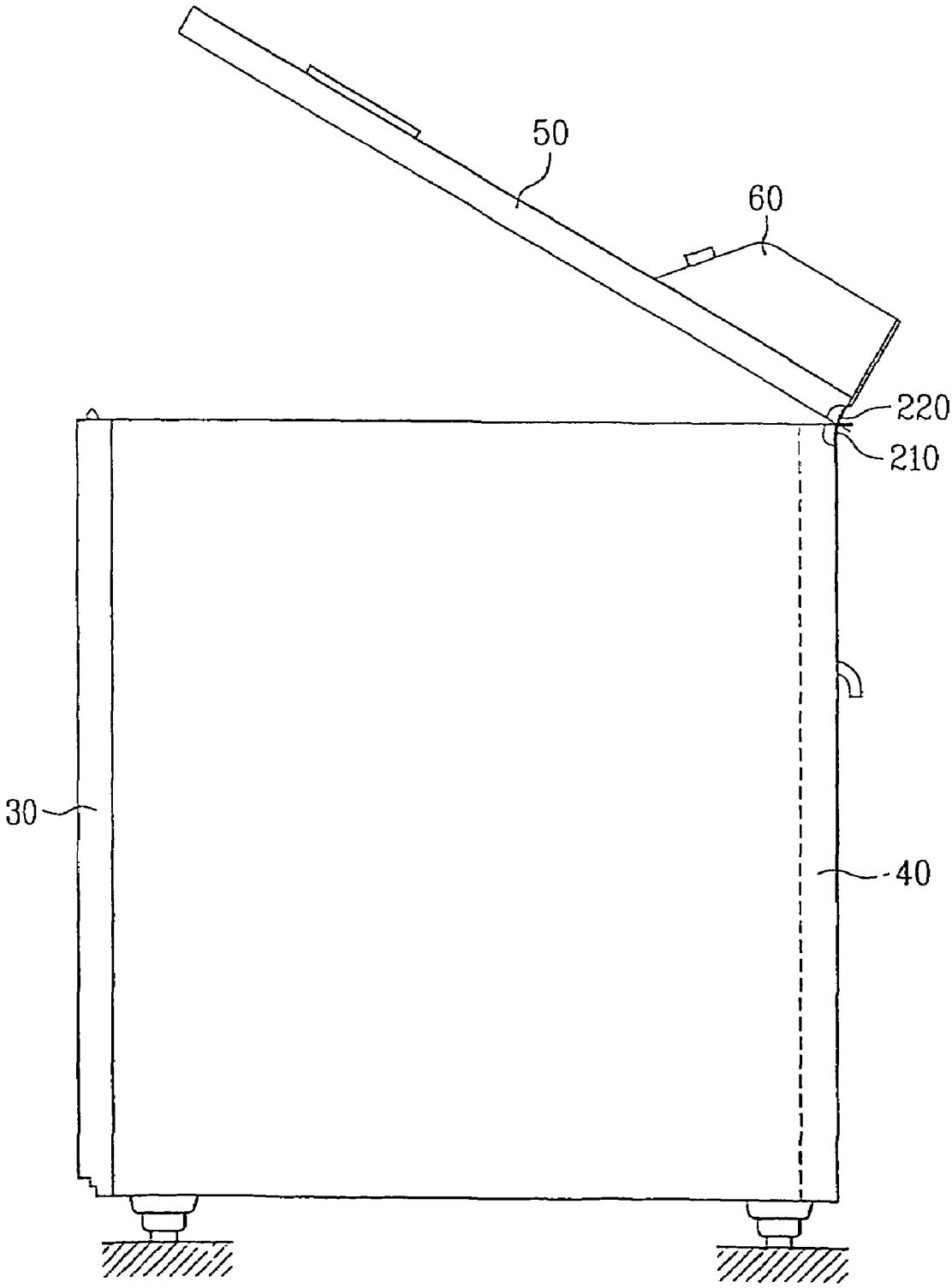
Figure 9C:
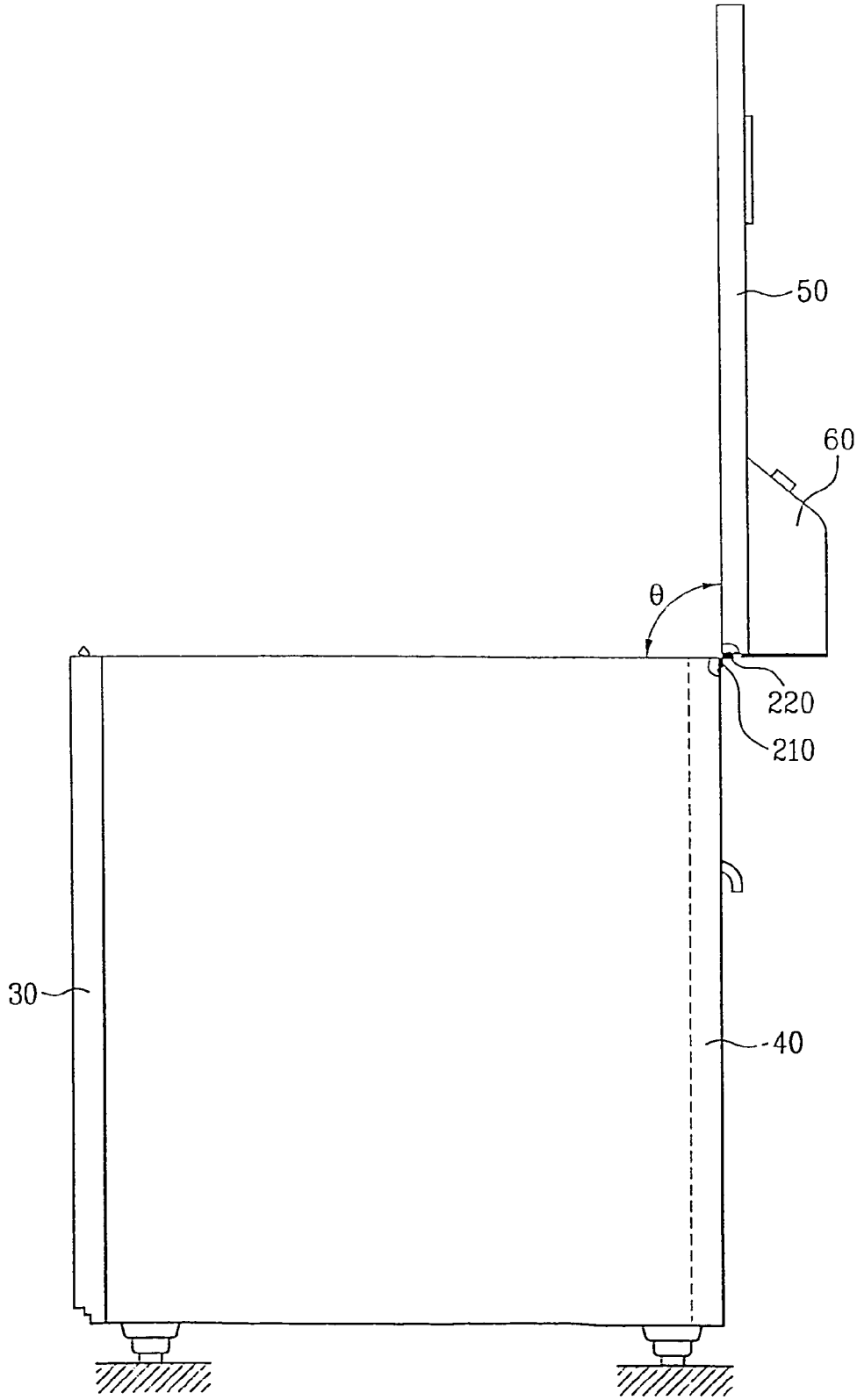

After the top panel 50 is disengaged from the locking member 100, if the user keeps lifting the top panel 50, the top panel 50, turning around the rear end thereof, opens a top of the cabinet. In more detail, as shown in FIG. 9B, when the top panel 50 starts to turn, the second part 222 of the second bracket breaks away from the second part 212 of the first bracket. The second bracket 220, supported on an edge of the through hole 213, keeps turning. Finally, as shown in FIGS. 6B, and 9C, when the second part 222 of the second bracket is brought into contact with the first part 211 of the first bracket, turning of the top panel 50 is stopped, and by the support of the first part 211 of the first bracket to the second part of the second bracket, the top panel 50 is sustained a turned position, continuously. If the top panel 50 turns at an angle less than 90°, the opened top panel 50 is liable to be closed only by a small impact or gravity if there is no additional supporting member. Therefore, as shown in FIG. 9C, it is required that a turned angle (opened angle) θ of the top panel 50 is at least 90°. Moreover, for maintaining a stable opened state of the top panel 50, it is preferable that the turned angle θ is 90°~120°. The turned angle θ can be increased by adjusting an angle between the first member 221 and second member 222 of the second bracket. Moreover, if the through hole 213 is enlarged, a clearance between the second member 222 of the second bracket and through hole 213 increases, according to which the second bracket 22 can be turned at a greater angle to increase the turned angle θ.

Through the foregoing series of process, the top of the cabinet is opened for the user or the service man to access to the components, and the user or the service man provides required service to the washing machine. As described before, while the top panel 50 is rigidly fastened to the cabinet with the locking member 100, the top panel 50 can be dismounted from the cabinet by applying a force. Therefore, actually the top panel 50 is detachably mounted on the cabinet with the locking member 100. In association with the locking member 100, the connection member 200 makes the top panel 50 detachable as well as rotatable, for convenience of dismounting. Moreover, since the connection member 200 connects the top panel 50 to the cabinet stably, no removal and transfer or storage of the heavy top panel 50 is required during service of the washing machine. At the end, in the present invention, the top panel 50 is separated easily, and a time period and process required for the service are reduced substantially.

In the meantime, when a bulky component, such as the inner tub 2 or the outer tub 1 is separated for repair, it is convenient that the top panel 50 is separated from the cabinet, fully. As described before, the first and second brackets 210 and 220 are joined only by inserting the second bracket 220 into the first bracket 210 without a fastening member. Therefore, if necessary, the top panel 50 can be separated from the cabinet, fully.

When service of the washing machine is finished, the top panel 50 is mounted on the other panel 20, 30, and 40 through a reverse process of the dismounting process described before. A likely, since the top panel 50 is rotatably joined to the cabinet with the connection member 200, if the user or the service man moves down the top panel 50, the top panel 50 is guided to the projection 300, and joined with the locking member 100, and mounted at once. Therefore, every time service of the washing machine is required, the top panel 50 can be dismounted/mounted, repeatedly.

As known, only size and shape of a cabinet of a home appliance vary with kind of the home appliance. Therefore, though the present invention has been described with reference to an embodiment applied to a washing machine, the present invention is applicable to other home appliances.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

In the cabinet of the present invention, the top panel is detachably mounted on adjoining other panels with fastening members. Moreover, the top panel is rotatably mounted on the other panels with the connection member. Accordingly, while, in the related art cabinet, the top panel is separated from the cabinet by removing the fastening members, the cabinet of the present invention can be separated from the cabinet easily. At the end, a time period required for separation of the top panel is reduced substantially, according to which the service of the washing machine can be made conveniently. Moreover, in the same reason, since mounting of the top panel can also be made simply in production of the washing machine, productivity is increased, and production cost can be reduced.

What is claimed is:

1. A cabinet for a washing machine comprising:

a base panel;

one pair of side panels provided to opposite edges of the base panel;

a front panel provided to front edges of the base and side panels;

a rear panel provided to rear edges of the base and side panels;

a top panel detachably provided to top edges of the rear panel; and a connection member including a first bracket fitted to the rear panel and a second bracket fitted to the top panel;

wherein the second bracket comprises a second part extending backward and substantially perpendicular from a first part fitted to a rear portion of the top panel;

the first bracket comprises a through hole, where the second part of the second bracket is inserted separably into the through hole, and a second part of the first bracket extending backward and substantially perpendicular from a first part of the first bracket fitted to the rear panel and having a seat for receiving the second bracket inserted therein selectively, and the second part of the second bracket is inserted into the through hole vertically and is arranged under the second part of the first bracket and rotates therein as a rotating angle that is limited by an engagement between the second part of the second bracket and the first part of the first bracket and between the first part of the second bracket and the second part of the first bracket, wherein the second bracket is retained in a fixed position by the first bracket when the top panel is opened.

2. The cabinet as claimed in claim 1, wherein the top panel is connected to the rear panel, continuously.

3. The cabinet as claimed in claim 1, wherein the top panel turns around a rear end thereof.

4. The cabinet as claimed in claim 1, further comprising a locking member fitted to the other panels adjoined to the top panel to join with the top panel, elastically.

5. The cabinet as claimed in claim 4, wherein the locking member is fitted to an upper edge of the front panel.

6. The cabinet as claimed in claim 5, wherein the locking member is inserted in a hole in the upper edge of each of the other panels.

7. The cabinet as claimed in claim 4, wherein the top panel has a flange configured to be caught at the locking member.

8. The cabinet as claimed in claim 4, wherein the locking member includes a body configured to be deformed elastically, and caught at the top cover.

9. The cabinet as claimed in claim 8, wherein the body includes a step formed so as to be caught at an edge of the top cover.

10. The cabinet as claimed in claim 8, wherein the body includes a sloped surface for guiding the edge of the top panel to be caught at the body.

11. The cabinet as claimed in claim 8, wherein the body is formed of elastic plate.

12. The cabinet as claimed in claim 8, wherein the locking member includes legs extended from the body so as to be caught at the other panel.

13. The cabinet as claimed in claim 12, wherein the legs include;

a first leg in a front part of the body; and a second leg in a rear part of the body opposite to the first leg.

14. The cabinet as claimed in claim 13, wherein the first leg includes;

a first part extended downwardly from the body; and a second part extended forwardly from the first part horizontally.

15. The cabinet as claimed in claim 14, wherein the first part is sloped forwardly.

16. The cabinet as claimed in claim 14, wherein the other panels include indented portions to be brought into contact with the second parts, respectively.

17. The cabinet as claimed in claim 13, wherein the second leg includes:

a first part extended downwardly from the body; and a second part extended backwardly so as to be in contact with the top panel.

18. The cabinet as claimed in claim 17, wherein the second part includes a first sloped part sloped upwardly.

19. The cabinet as claimed in claim 18, wherein the second part further includes a second sloped part sloped downwardly from the first sloped part.

20. The cabinet as claimed in claim 8, wherein the locking member further includes a supplementary leg extended from the body for sustaining the body with respect to the other panels.

21. The cabinet as claimed in claim 8, wherein the body is pressed with pressing means so as to be deformed.

22. The cabinet as claimed in claim 21, wherein the pressing means includes a pressing tool to be inserted in the cabinet.

23. The cabinet as claimed in claim 21, wherein the pressing means includes a pressing member fitted to the top panel for being pressed to deform the body.

24. The cabinet as claimed in claim 1, wherein the top panel turns greater than 90° with respect to the other panels.

25. The cabinet as claimed in claim 1, wherein the top panel turns up to 90°~120° with respect to the other panels.

26. The cabinet as claimed in claim 1, wherein the first bracket includes a first projection extended therefrom so as to be inserted in the rear panel.

27. The cabinet as claimed in claim 26, wherein the first bracket includes a second projection extended therefrom so as to be inserted in the rear panel.

28. The cabinet as claimed in claim 1, wherein the first bracket includes a fastening member for fastening the first bracket to the rear panel, and supporting the second bracket when the top panel is opened.

29. The cabinet as claimed in claim 1, wherein the second bracket includes a third projection extended so as to be inserted in the top panel.

30. The cabinet as claimed in claim 1, wherein the second bracket includes stoppers for preventing the second bracket from breaking away from the first bracket during the turning of the top panel.

31. The cabinet as claimed in claim 1, further comprising ribs in bent parts of the first and second brackets.

32. The cabinet as claimed in claim 1, wherein the through hole is provided in a connection part of the first and second parts in the first bracket.

33. The cabinet as claimed in claim 1, wherein the first bracket includes a fastening member positioned in the first part for fastening the first bracket to the rear panel, and supporting the second part of the second bracket when the top panel is opened.

34. The cabinet as claimed in claim 33, wherein the fastening member is a flat head screw.

35. The cabinet as claimed in claim 1, further comprising projection members fitted to top edges of the other panels adjoining to the top panel for guiding the top panel.

36. The cabinet as claimed in claim 35, wherein the projection member is fitted to a center of at least the front panel among the panels.

37. The cabinet as claimed in claim 35, wherein the projection member is fixed to the top edge of the panel directly without any fastening member.

38. The cabinet as claimed in claim 35, wherein the top panel includes a recess for receiving the projection member partially.

39. The cabinet as claimed in claim 35, wherein the projection member includes at least more than one legs extended from a lower part to upward so as to be caught at the panel.

40. The cabinet as claimed in claim 39, wherein the projection member includes a flange extended in a radial direction and supported on the upper surface of the panel.

41. The cabinet as claimed in claim 40, wherein a gap between an end of the leg and the flange is the same or greater than a thickness of the panel.

42. The cabinet as claimed in claim 1, further comprising a locking member fitted to the front panel and elastically connected to the top panel, and a connection member rotatably connected to the rear panel.

43. The washing machine as claimed in claim 1, wherein when the top panel is opened, the first bracket prohibits rotation of the second bracket beyond a fixed angle.

44. A washing machine comprising:

a washing tub rotatably mounted for washing laundry;

a driving device for rotating the washing tub; and a cabinet for holding the washing tub and the driving device, including:

a base panel, one pair of side panels provided to opposite edges of the base panel, a front panel provided to front edges of the base and side panels, a rear panel provided to rear edges of the base and side panels, a top panel detachably provided to top edges of the rear panel, and a connection member including a first bracket fitted to the rear panel and a second bracket fitted to the top panel;

wherein the second bracket comprises a second part extending backward and substantially perpendicular from a first part fitted to a rear portion of the top panel;

the first bracket comprises a through hole, where the second part of the second bracket is inserted separably into the through hole, and a second part of the first bracket extending backward and substantially perpendicular from a first part of the first bracket fitted to the rear panel and having a seat for receiving the second bracket inserted therein selectively, and the second part of the second bracket is inserted into the through hole vertically and is arranged under the second part of the first bracket and rotates therein as a rotating angle that is limited by an engagement between the second part of the second bracket and the first part of the first bracket and between the first part of the second bracket and the second part of the first bracket, wherein the second bracket is retained in a fixed position by the first bracket when the top panel is opened.

45. The washing machine as claimed in claim 44, wherein the top panel is connected to the rear panel, continuously.

46. The washing machine as claimed in claim 44, wherein the top panel turns around a rear end thereof.

47. The washing machine as claimed in claim 44, further comprising a locking member fitted to the other panels adjoined to the top panel to join with the top panels elastically.

48. The washing machine as claimed in claim 47, wherein the locking member is fitted to an upper edge of the front panel.

49. The washing machine as claims in claim 47, wherein the locking member is fitted to an upper edge of the front panel.

50. The washing machine as claimed in claim 49, wherein the body includes a step formed so as to be caught at an edge of the top cover.

51. The washing machine as claimed in claim 49, wherein the body includes a sloped surface for guiding the edge of the top panel to be caught at the body.

52. The washing machine as claimed in claim 49, wherein the locking member includes legs extended from the body so as to be caught at the other panel.

53. The washing machine as claimed in claim 49, wherein the locking member further includes a supplementary leg extended from the body for sustaining the body with respect to the other panels.

54. The washing machine as claimed in claim 44, wherein the first bracket includes a first projection extended therefrom so as to be inserted in the rear panel.

55. The washing machine as claimed in claim 44, wherein the first bracket includes a second projection extended therefrom so as to be inserted in the rear panel.

56. The washing machine as claimed in claim 44, wherein the first bracket includes a fastening member for fastening the first bracket to the rear panel, and supporting the second bracket when the top panel is opened.

57. The washing machine as claimed in claim 44, wherein the second bracket includes a third projection extended so as to be inserted in the top panel.

58. The washing machine as claimed in claim 44, wherein the second bracket includes stoppers for preventing the second bracket from breaking away from the first bracket during the turning of the top panel.

59. The washing machine as claimed in claim 44, further comprising ribs in bent parts of the first and second brackets.

60. The washing machine as claimed in claim 44, further comprising projection members fitted to top edges of the other panels adjoining to the top panel for guiding the top panel.

61. The washing machine as claimed in claim 60, wherein the projection member is fitted to a center of at least the front panel among the panels.

62. The washing machine as claimed in claim 60, wherein the top panel includes a recess for receiving the projection member partially.

63. The washing machine as claimed in claim 60, wherein the projection member includes at least more than one legs extended from a lower part to upward so as to be caught at the panel.

64. The washing machine as claimed in claim 63, wherein the projection member includes a flange extended in a radial direction and supported on the upper surface of the panel.

65. The washing machine as claimed in claim 44, further comprising a locking member fitted to the front panel and elastically connected to the top panel, and a connection member rotatably connected to the rear panel.

66. The washing machine as claimed in claim 44, wherein when the top panel is opened, the first bracket prohibits rotation of the second bracket beyond a fixed angle.

67. A cabinet for a washing machine comprising:

a base panel;

one pair of side panels provided to opposite edges of the base panel;

a front panel provided to front edges of the base and side panels;

a rear panel provided to rear edges of the base and side panels;

a top panel detachably provided to top edges of the rear panel; and a connection member including a first bracket fitted to the rear panel and a second bracket fitted to the top panel;

wherein the second bracket comprises:

a first part of the second bracket; and a second part of the second bracket extending backward from the first part of the second bracket fitted to the top panel; and wherein the first bracket comprises:

a through hole, where the second part of the second bracket is inserted separably into the through hole;

a first part of the first bracket;

a second part of the first bracket extending backward from the first part of the first bracket fitted to the rear panel and having a seat for receiving the second bracket inserted therein selectively, wherein the second part of the second bracket is inserted into the through hole vertically and is arranged under the second part of the first bracket and rotates therein at a rotating angle that is limited by an engagement between the second part of the second bracket and the first part of the first bracket and between the first part of the second bracket and the second part of the first bracket, wherein the second bracket is retained in a fixed position by the first bracket when the top panel is opened.

* * * * *